US005921829A

United States Patent [19]

Iwata

[11] Patent Number: 5,921,829

[45] Date of Patent: Jul. 13, 1999

[54] OUTBOARD MOTOR COOLING SYSTEM

[75] Inventor: Yoshibumi Iwata, Hamamatsu, Japan

[73] Assignee: Sanshin Kogyo Kabushiki Kaisha, Hamamatsu, Japan

[21] Appl. No.: 08/863,896

[22] Filed: May 27, 1997

[30] Foreign Application Priority Data

May 25, 1996 [JP] Japan ..... 8-153188

[51] Int. Cl.[6] ..... B63H 21/10

[52] U.S. Cl. ..... 440/88; 440/89

[58] Field of Search ..... 440/88, 89, 900; 123/195 D, 196 AB, 195 C

[56] References Cited

U.S. PATENT DOCUMENTS

| | | | |
|---|---|---|---|
| 4,260,011 | 4/1981 | Brown | 165/297 |
| 5,048,467 | 9/1991 | Kojima . | |
| 5,109,809 | 5/1992 | Fujimoto . | |
| 5,215,164 | 6/1993 | Shibata | 184/6.13 |
| 5,383,803 | 1/1995 | Pilgrim | 440/88 |
| 5,555,855 | 9/1996 | Takahashi . | |
| 5,647,315 | 7/1997 | Saito . | |

*Primary Examiner*—Ed L. Swinehart
*Attorney, Agent, or Firm*—Knobbe, Martens, OLson & Bear LLP

[57] ABSTRACT

A cooling system for an outboard motor propelling a watercraft and powered by an engine, is disclosed. The cooling system includes a first cooling system comprising a coolant flow path through the engine and an oil cooler for cooling the engine and oil of the lubricating system. The cooling system includes a second cooling system comprising a water path from the body of water in which the motor is operating to a heat exchanger and thereon to a discharge back to the body of water. The first cooling system includes two branches, one branch which passes through the heat exchanger and a second branch which does not. A control is provided for routing the coolant through the first branch for cooling within the heat exchanger when the coolant is hot, and for routing through the second branch when the coolant is cool, allowing the engine to warm up.

13 Claims, 2 Drawing Sheets

OUTBOARD MOTOR COOLING SYSTEM

FIELD OF THE INVENTION

The present invention relates to a cooling system for an engine of an outboard motor of the type utilized to propel a watercraft.

BACKGROUND OF THE INVENTION

Outboard motors which are used to propel watercraft are often powered by internal combustion engines. These engines do not run efficiently when they are too hot or too cold. For example, when the engine is hot, the combustion efficiency is greatly lowered. On the other hand, if the engine is cold, the lubricating system may not function properly.

Typically, these engines are cooled with a liquid cooling system. In this system, water is drawn from the body of water in which the motor is operating by a pump. The pump delivers the water directly from the body of water to the water passages or jackets within the engine for cooling its various parts.

A problem is encountered with this type of cooling system when the motor is operated in cold water, such as in the winter. In this event, very cold water is continuously drawn into the cooling system. This cold water prevents the engine from warming up. Further, if a thermostat is used to prevent the passage of water through the engine for some time while it warms up, the cold water must eventually flow through the engine to cool it. The temperature gradient at the interface between the hot engine and cold water can be damaging to various of the engine parts.

At the same time, any cooling system which is utilized must be simple, and should allow the lubricant in the lubricating system to both achieve a proper operating temperature but prevent it from overheating.

A cooling system for an engine of an outboard motor which achieves the above-stated goals is desired.

SUMMARY OF THE INVENTION

In accordance with the present invention, there is provided a cooling system for an engine of an outboard motor. This engine preferably has an engine body with one or more coolant passages or jackets therein for cooling various portions of the engine. In addition, the engine preferably includes an exhaust manifold or pipe which routes exhaust from the engine and which has a cooling jacket thereabout. A lubricating system provides lubricant to the engine.

The cooling system of the motor preferably includes a primary and a secondary cooling system. The primary system is a closed loop or path through which a pump pumps coolant. This path routes coolant to the coolant passages or jackets in the engine for cooling the engine.

The secondary cooling system has an inlet through which water is drawn from the body of water in which the motor is being operated. This water is routed through a heat exchanger and thereafter to a discharge back to the body of water. Preferably, the water is routed through the cooling jacket surrounding an exhaust manifold of the engine after it passes through the heat exchanger. A pump is provided for pumping the water through the second cooling system.

In accordance with the present invention, at least one part of the primary cooling system passes through the heat exchanger. Preferably, one branch of the primary cooling system passes through the heat exchanger, while a second branch does not. A thermostat is provided along the coolant path directing the coolant through the first or second branches. In the event the coolant in the primary coolant system is hot, the thermostat permits the coolant to flow through the first branch for cooling by the water passing through the heat exchanger. If the coolant is cold, the thermostat routes the water through the second branch and back to the engine for allowing the coolant and engine to warm up.

Preferably, the lubricant system includes an oil cooler through which the lubricating oil is passed. The oil cooler is positioned along the coolant path of the primary coolant system, whereby the coolant cools the oil.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In general, the present invention is cooling system for an engine of an outboard motor. One part of the cooling system routes coolant through jackets or passages formed within the engine. This coolant is also selectively routed through a heat exchanger for transferring heat therefrom to water drawn from a body of water in which the motor is operating by a second part of the cooling system. This water may also be passed through an exhaust manifold cooling jacket before being returned to the body of water.

Figure 1:
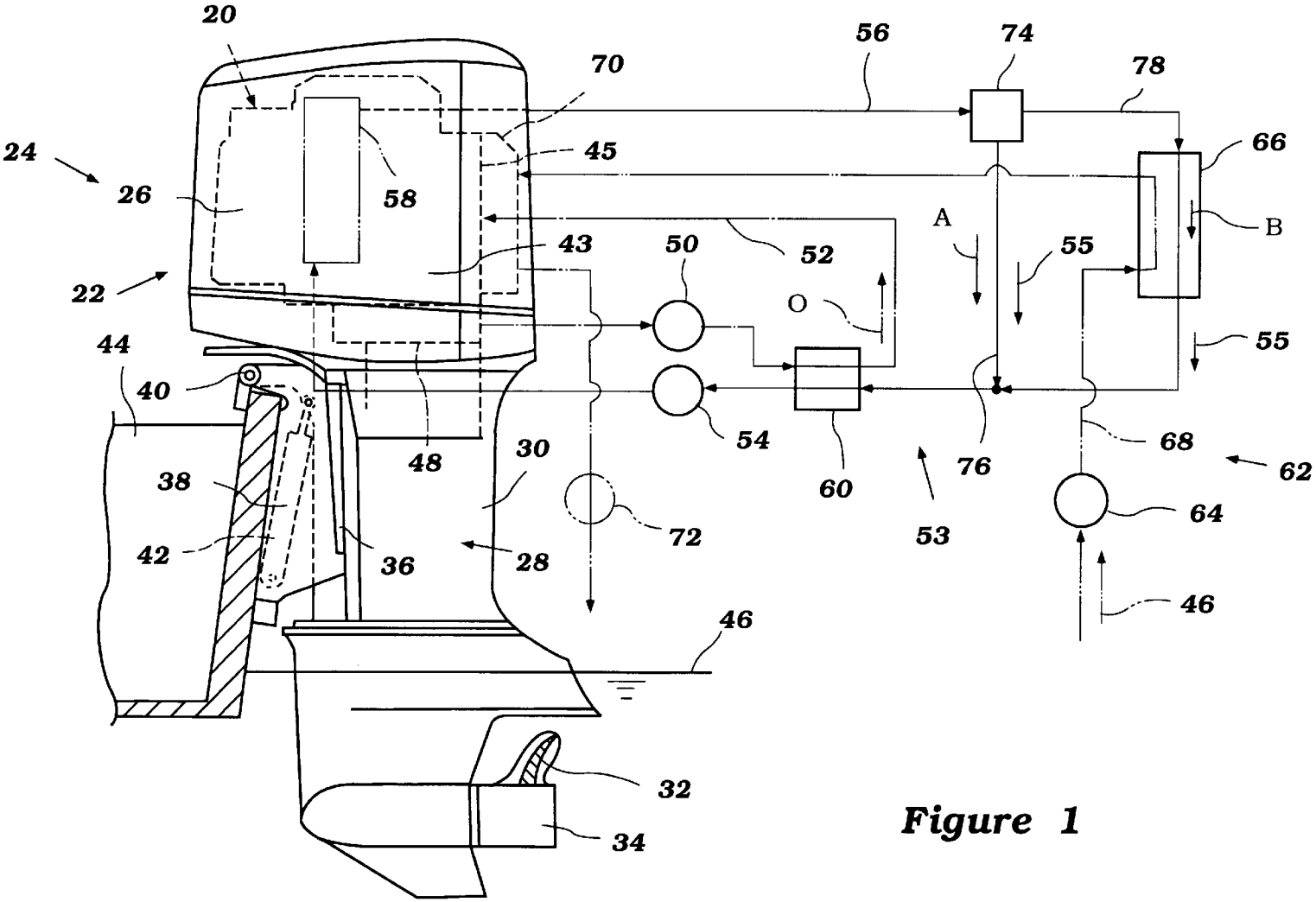
FIG. 1 is a side view, in partial cross-section, of an outboard motor propelling a watercraft, powered by an engine (illustrated in phantom) and having a cooling system in accordance with a first embodiment of the present invention.

The present invention will now be described in more detail with reference to FIG. 1. As illustrated therein, the cooling system of the present invention is provided cooling an engine 20 of an outboard motor 22 powering a watercraft 24.

The outboard motor 22 includes a cowling 26 which houses the engine 20. A lower unit 28 depends below the cowling 26. The lower unit 28 is preferably defined by a casing 30.

The motor 22 further includes a water propulsion device such as a propeller 32. The propeller 32 has a shaft 34 which extends to a transmission (not shown) positioned within the lower unit 28. The engine 22 is arranged so that a crankshaft (not shown) thereof is vertically extending. The crankshaft drives a drive shaft which extends downwardly through the lower unit 28 to the transmission for driving the propeller 32, as is well known in the art.

The motor 22 is preferably movably connected to the watercraft 24. A vertical steering shaft (not shown) is connected to the motor 20 and positioned within a steering or swivel bracket 36, allowing the motor 20 to be moved left or right about a vertically extending axis for steering the watercraft 24. In addition, the motor 20 is connected to a mounting bracket 38. The mounting bracket 38 is rotatably connected by a horizontally extending pin 40 to a clamp or bracket which is connected to the hull 44 of the watercraft 24. A fluid-operated cylinder 42 is preferably used to raise and lower (i.e. tilt) the motor 20 about the horizontally extending axis through the pin 40.

When in use, the propeller 32 of the motor 22 is positioned within a body of water 46. Most preferably, the cooling system of the present invention is utilized to cool a motor 22 which is being operated in cold salt water, although the motor 22 may be operated in fresh water as well.

Because the invention deals primarily with the cooling system for the engine 20, the full details of the outboard motor 22 and engine 20 are not illustrated nor will they be described. Reference may be had to any known construction for those details of the outboard motor and engine which are not illustrated or described and which may be required to facilitate the practicing of the invention in such an application.

The engine 20 may be any of a variety of types and be arranged in any of the manners known to those skilled in the art, such as in "V", in-line, opposed or rotary. The engine may have any number of cylinders, such as one, two, four or more. The engine 20 may also operate on a two-cycle or four-cycle principle.

The engine 22 illustrated has a body 43 which defines one or more cylinders 45 each having a piston movably mounted therein which is connected to a crankshaft (not shown). The engine 22 is preferably arranged so that the crankshaft is vertically extending for coupling to a drive shaft (also not show) which extends through the lower unit 28 to the transmission which drives the propeller 32.

Preferably, a lubricating system provides lubricating oil to the engine 20. This system preferably includes an oil reservoir formed by a pan 48 positioned below the engine 20. A pump 50 draws oil (O) from the reservoir and routes it through an oil passage 52. This passage 52 preferably leads to one or more oil passages or galleries in the engine 22 for lubricating the various parts thereof, as is known to those skilled in the art. The oil then returns, with the aid of gravity, through an oil return passage (not shown) from the engine 20 to the oil reservoir, from which it is pumped and re-circulated through the engine 22.

The engine 22 also includes a cooling system in accordance with the present invention. The cooling system has a primary cooling system 53 comprising a water pump 54, a coolant pipe or passage 56, and at least one coolant passage or jacket 58 in the engine 20. In this arrangement, coolant 55 is delivered by the pump 54 through one part of the path or passage 56 to the coolant jacket 58 within the engine 22. The coolant then exits the engine 22 and passes through another part of the path or passage 56 leading back to the pump 54. In this manner, the primary cooling system 53 comprises a closed loop or path.

The coolant 55 used in this primary cooling system 53 may comprise water, antifreeze or other coolants known to those skilled in the art. In addition, any of a variety of means may be provided for effectuating movement of the coolant 55 around the coolant path.

The coolant jacket 58 positioned within the engine 22 may comprise one or more jackets surrounding each cylinder 45, or other passages or the like formed within the engine 22, as well known in the art.

Preferably, an oil cooler 60 is provided for cooling the lubricating oil O with the coolant 55 in the primary cooling system 53. The coolant passage 56 delivers coolant to the cooler 60, and the oil passage 52 delivers oil to the cooler. The cooler 60 is arranged so that heat is transferred from the oil to the coolant, as is well known to those skilled in the art.

The oil cooler 60 is preferably positioned along the oil path 52 after the pump 54 but before the engine 20, and along the coolant path 56 before the pump 54 and after the engine 20.

The cooling system preferably includes a secondary cooling system 62. The secondary cooling system 62 includes a pump 64 for drawing water 46 through an inlet or intake from the body of water in which the motor 22 is being operated. This, water 46, which preferably comprises salt-water, is routed from the pump 64 to a heater exchanger 66 through a deliver pipe 68.

Preferably, the water 46 is then routed from the heat exchanger 66 to a cooling jacket for cooling an exhaust manifold or pipe 70 which routes exhaust from the engine 22. After passing through the cooling jacket surrounding the exhaust manifold 70, the water 46 is returned to the body of water through a return path including a discharge or outlet.

Instead of positioning the pump 64 at the intake side of the secondary cooling system 62, the pump may be positioned at location 72 as illustrated. In this position 72 the pump is at the discharge end of the system.

The heat exchanger 66 is arranged so that coolant 55 in the primary cooling system 53 may pass therethrough. In the embodiment illustrated in FIG. 1, a thermostat 74 is positioned along the coolant pipe or path 56 between the outlet of the cooling jackets in the engine 20 and the inlet of the pump 54. Most preferably, the thermostat 74 is positioned at a point where the coolant path or passage 56 divides into a first branch passage 76 and a second branch passage 78. The branch passages 76, 78 eventually converge and then lead to the pump 54.

In the event the coolant 55 in the primary cooling system 53 is cool, the thermostat 74 operates to divert coolant 55 passing through the first branch passage 76 and along a path "A" of the coolant path 56 back to the pump 54.

In the event the temperature of the coolant 55 in the primary cooling system 53 is above a predetermined high temperature, the thermostat 74 diverts the coolant 55 into the second branch passage 78 along a path "B". This branch passage 78 extends through the heat exchanger 66 and thereon back to the pump 54.

As the coolant 55 passes through the heat exchanger 66, heat is transferred therefrom to the cooler water 46 passing through the heat exchanger as delivered through the delivery pipe 68. In this manner, the coolant 55 is cooled, and more effectively cools the engine 22 and oil.

The cooling arrangement of the present invention has several advantages. First, the primary cooling system 53 which cools the engine 20 is closed. In other words, the coolant 55 therein is not drawn from the body of water in which the motor 22 is operating, and thus the temperature of the coolant used to cool the engine is not dependent upon the temperature of the water of the body of water.

At the same time, the secondary cooling system 62 permits cooling of the coolant 55 in the primary cooling system 53 in the event it becomes too hot. This cooling effect, however, can be strictly controlled with the thermostat 74.

Also, a simple cooling arrangement for the exhaust system or manifold of the engine 20 is provided. The water 46 passing through the secondary cooling system 62 is routed to the water jacket 70 for cooling the manifold and then discharged back to the body of water.

The temperature of the lubricating oil of the engine 20 is also controlled. First, if the temperature of the oil is low, it will heat up with the coolant 55 in the primary cooling system 53 (the thermostat 74 will cause branch "A" to open). On the other hand, when the oil is hot, heat is transferred therefrom to the cooler coolant 55.

Figure 2:
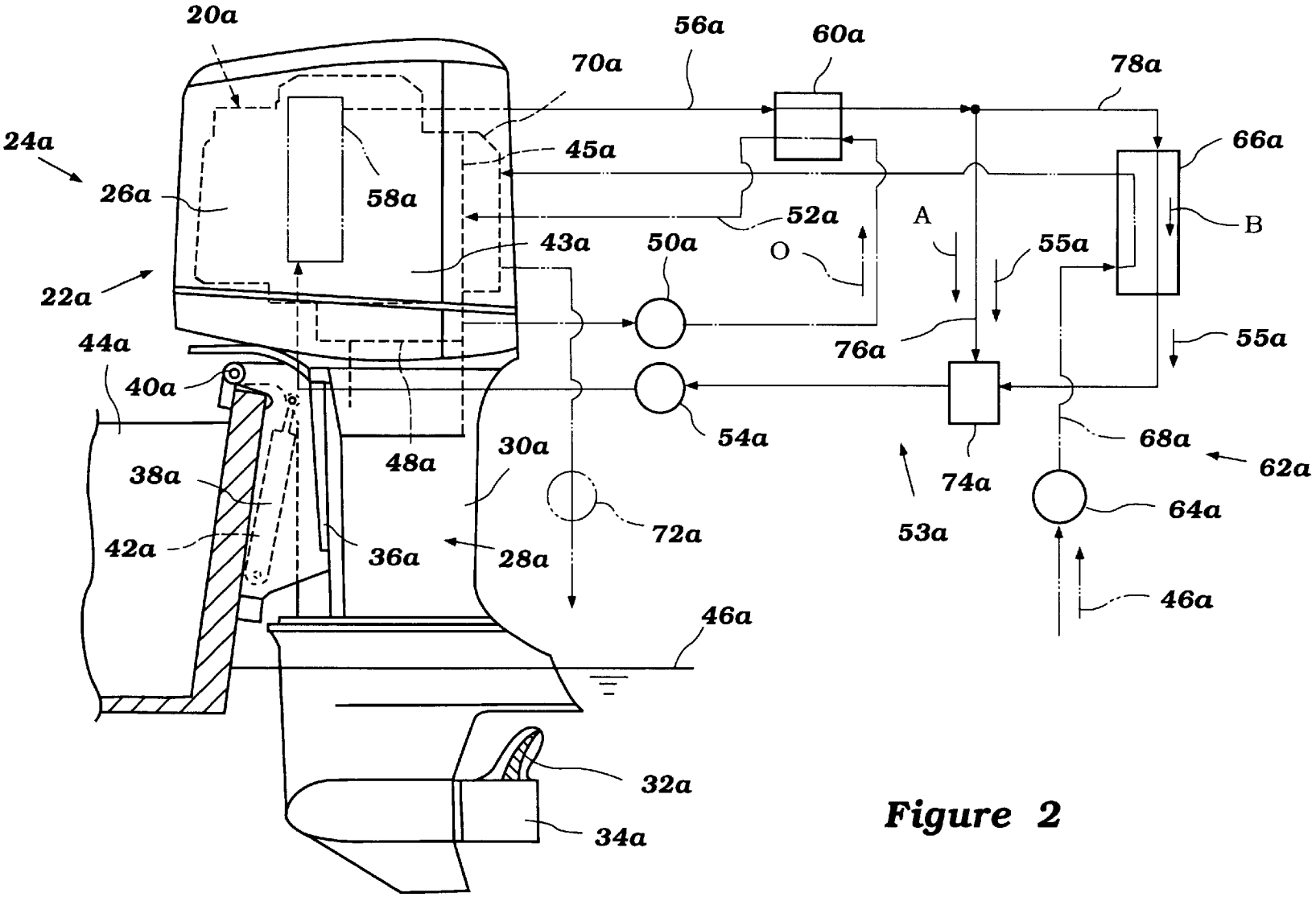
FIG. 2 is a side view, in partial cross-section, of an outboard motor propelling a watercraft powered by an engine (illustrated in phantom) and having a cooling system in accordance with a second embodiment of the present invention.

A cooling system in accordance with a second embodiment of the present invention is illustrated in FIG. 2. In the description and illustration of this embodiment cooling system, like parts have been given like numbers to those described and illustrated in the first embodiment, except that an "a" designator has been added thereto.

This cooling system is also preferably utilized with an engine 20*a* of an outboard motor 22*a* powering a watercraft 24*a* in a manner similar to that described above. This cooling system is similar to that illustrated and described above, with the exception of the following.

The oil cooler 60*a* is preferably along the oil path 52*a* after the oil pump 50*a*, as described above. The oil cooler 60*a* is also positioned along the coolant path 56*a* before the pump 54*a*, but in this instance is positioned along the path 56*a* before the thermostat 74*a*.

Also, the branches 76*a*,78*a* of the coolant path 56*a* preferably divide after the engine 20*a*, and then converge at the thermostat 74*a* before the pump 54*a*. In this arrangement, coolant 55*a* fills both passages 76*a*,78*a*, but coolant only flows through the passage 76*a*,78*a* which is opened to the pump 54*a* by the thermostat 74*a*.

In this embodiment, the thermostat 74*a* is positioned to monitor the temperature of the coolant 55*a* only after it has been heated by the oil O in the heat exchanger. In addition, after heating by the oil, if the temperature of the coolant 55*a* is too high, the thermostat 74*a* moves to a position to allow coolant 55*a* to flow through passage 78*a* to be cooled by the water 46*a* in the heat exchanger 66*a*.

While a thermostat 74, 74*a* has been described as the mechanism for controlling the flow of coolant 55, 55*a* through the branches, other means for controlling the coolant flow are contemplated. For example, a valve may be provided in place of the thermostat and a temperature sensor placed along the coolant path. The output of the sensor may be routed to a control unit for controlling the position of the valve.

Of course, the foregoing description is that of preferred embodiments of the invention, and various changes and modifications may be made without departing from the spirit and scope of the invention, as defined by the appended claims.

What is claimed is:

1. A cooling system for an engine of an outboard motor powering a watercraft positioned in a body of water, said engine having a cooling jacket for cooling an engine body and an exhaust system for discharging combustion exhaust products from said engine, said cooling system including a primary cooling system having a closed coolant path, said path passing through said engine cooling jacket, and a pump for pumping coolant around said path, and including a secondary cooling system, said secondary cooling system including a pump drawing water from the body of water in which said motor is positioned and a passage through which said water is delivered to a heat exchanger and through an exhaust system cooling jacket, said path of said primary cooling system including at least one part passing through said heat exchanger, whereby said coolant in said primary cooling system is cooled by said water delivered to said heat exchanger through said secondary cooling system.

2. The cooling system in accordance with claim 1, wherein said path of said primary cooling system includes a first branch and a second branch with only one of said branches leading through said heat exchanger.

3. The cooling system in accordance with claim 2, wherein said primary cooling system includes a thermostat positioned along said path, said thermostat selectively permitting coolant to pass through said first branch and said second branch.

4. The cooling system in accordance with claim 3, wherein said first and second branches divide at a first point along said path and converge at said thermostat.

5. The cooling system in accordance with claim 3, wherein said first and second branches divide at said thermostat and converge at a point along said path downstream of said thermostat.

6. The cooling system in accordance with claim 1, wherein said path of said primary cooling system includes a first coolant passage leading from said pump to an inlet of said engine cooling jacket and a second coolant passage leading from an outlet of said engine cooling jacket back to said pump.

7. The cooling system in accordance with claim 6, wherein said second coolant passage includes a first branch and a second branch, one of said branches leading through said heat exchanger.

8. The cooling system in accordance with claim 1, wherein said pump of said secondary cooling system is positioned between a water inlet and said heat exchanger.

9. A cooling system for an engine of an outboard motor powering a watercraft positioned in a body of water, said cooling system including a primary cooling system having a closed coolant path, said path passing through said engine, and a pump for pumping coolant around said path, and including a secondary cooling system, said secondary cooling system including a pump drawing water from the body of water in which said motor is positioned and a passage through which said water is delivered to a heat exchanger, said path of said primary cooling system including at least one part passing through said heat exchanger, whereby said coolant in said primary cooling system is cooled by said water delivered to said heat exchanger, said engine including a lubricating system having an oil cooler and said path of said primary cooling system passes through said oil cooler for cooling lubricating oil passing therethrough, and a thermostat for controlling the communication of said primary cooling system with said heat exchanger, said oil cooler communicating with said primary cooling system at a location where said engine cooling jacket and said oil cooler communicate with each other regardless of the condition of said thermostat.

10. The cooling system in accordance with claim 9, wherein said oil cooler is positioned along said path after said heat exchanger but before said pump.

11. The cooling system in accordance with claim 9, wherein said oil cooler is positioned along said path before said heat exchanger.

12. The cooling system in accordance with claim 8, wherein said secondary cooling system includes a delivery line extending from said heat exchanger to a cooling jacket of an exhaust manifold for delivering water from said heat exchanger to said cooling jacket for cooling said exhaust manifold.

13. The cooling system in accordance with claim 11, wherein said pump of said secondary cooling system is positioned along a drain line extending from said cooling jacket of said exhaust manifold to a discharge for returning said water to said body of water.

* * * * *